US007492867B1

(12) United States Patent
Richardson

(10) Patent No.: US 7,492,867 B1
(45) Date of Patent: Feb. 17, 2009

(54) NANOPARTICLE SEEDED SHORT-WAVELENGTH DISCHARGE LAMPS

(75) Inventor: Martin Richardson, Geneva, FL (US)

(73) Assignee: University of Central Flordia Research Foundation, Inc., Orlando, FL (US)

( * ) Notice: Subject to any disclaimer, the term of this patent is extended or adjusted under 35 U.S.C. 154(b) by 0 days.

(21) Appl. No.: 10/982,380

(22) Filed: Nov. 5, 2004

Related U.S. Application Data

(63) Continuation-in-part of application No. 10/795,814, filed on Mar. 8, 2004, now Pat. No. 6,862,339, and a continuation-in-part of application No. 10/082,658, filed on Oct. 19, 2001, now Pat. No. 6,865,255, which is a continuation-in-part of application No. 09/881,620, filed on Jun. 14, 2001, now Pat. No. 6,831,963, which is a continuation-in-part of application No. 09/685,291, filed on Oct. 10, 2000, now Pat. No. 6,377,651.

(60) Provisional application No. 60/517,523, filed on Nov. 5, 2003, provisional application No. 60/242,102, filed on Oct. 20, 2000, provisional application No. 60/158,723, filed on Oct. 11, 1999.

(51) Int. Cl.
*H05G 2/00* (2006.01)

(52) U.S. Cl. ..... 378/119; 250/504 R

(58) Field of Classification Search ..... 378/119, 378/143; 250/504 R
See application file for complete search history.

(56) References Cited

U.S. PATENT DOCUMENTS

| | | | | |
|---|---|---|---|---|
| 4,182,574 | A | 1/1980 | Quillfeldt | 356/318 |
| 4,723,262 | A * | 2/1988 | Noda et al. | 378/119 |
| 5,459,771 | A | 10/1995 | Richardson | 378/119 |
| 5,577,091 | A | 11/1996 | Richardson | 378/119 |
| 5,577,092 | A | 11/1996 | Richardson | 378/143 |
| 5,991,360 | A * | 11/1999 | Matsui et al. | 378/119 |
| 6,285,743 | B1 | 9/2001 | Kondo | 378/119 |
| 6,304,630 | B1 | 10/2001 | Hubertus | 378/119 |
| 6,307,913 | B1 * | 10/2001 | Foster et al. | 378/119 |
| 6,377,651 | B1 | 4/2002 | Richardson et al. | 378/34 |
| 6,493,423 | B1 | 12/2002 | Josephus | 378/119 |
| 2002/0015473 | A1 | 2/2002 | Hertz | 378/143 |
| 2002/0044629 | A1 | 4/2002 | Hertz | 378/119 |
| 2002/0070353 | A1 | 6/2002 | Richardson | 250/492.1 |
| 2002/0090054 | A1 | 7/2002 | Sogard | 378/119 |
| 2002/0141536 | A1 | 10/2002 | Richardson | 378/119 |
| 2003/0108155 | A1 | 6/2003 | Wilkins | 378/119 |
| 2003/0223544 | A1 * | 12/2003 | Murakami | 378/119 |
| 2004/0170252 | A1 | 9/2004 | Richardson | 378/119 |
| 2004/0208286 | A1 | 10/2004 | Richardson | 378/119 |

FOREIGN PATENT DOCUMENTS

JP 2003043198 A * 2/2003

* cited by examiner

*Primary Examiner*—Chih-Cheng G Kao
(74) *Attorney, Agent, or Firm*—Brian S. Steinberger; Phyllis K. Wood; Law Offices of Brian S. Steinberger, P.A.

(57) ABSTRACT

Methods, systems and apparatus for using nanoparticle seeded short-wavelength discharge generator sources discharge sources, for use with X-ray, XUV and EUV light emissions. Applications can include EUV lithography. Additional embodiments can use the generator sources for Hollow Cathode Plasma Discharge (HCPD) lamps, and dense plasma focus (DPF) devices and other sources. Target streams of gases such as Xe and nanoparticles such as tin, copper, or lithium can be heated with laser type sources to emit nano-droplets therefrom.

38 Claims, 6 Drawing Sheets

NANOPARTICLE SEEDED SHORT-WAVELENGTH DISCHARGE LAMPS

This invention claims the benefit of U.S. Provisional Patent Application Ser. No. 60/517,523 filed Nov. 5, 2003, and this invention is a Continuation-In-Part of U.S. application Ser. No. 10/082,658 filed Oct. 19, 2001, now U.S. Pat. No. 6,865,255, which is a continuation-in-part of U.S. application Ser. No. 09/881,620 filed Jun. 14, 2001, now U.S. Pat. No. 6,831,963 that further claims the benefit of U.S. Provisional application No. 60/242,102 filed Oct. 20, 2000, and which is a Continuation-In-Part of U.S. application Ser. No. 09/685,291 filed Oct. 10, 2000, now U.S. Pat. No. 6,377,651 that further claims the benefit of U.S. Provisional Application No. 60/158,723 filed Oct. 11, 1999, and this invention is a Continuation-In-Part of U.S. application Ser. No. 10/795,814 filed Mar. 8, 2004, now U.S. Pat. No. 6,862,339.

FIELD OF THE INVENTION

This invention relates to discharge sources, in particular to methods, systems and devices for nanoparticle seeded short-wavelength discharge sources for X-Ray, XUV and EUV emissions that can be used in applications such as lithography, and as Hollow Cathode Plasma Discharge (HCPD) lamps, dense plasma focus (DPF) sources and other sources.

BACKGROUND AND PRIOR ART

Pulsed electric discharges are well known sources of short-wavelength light, having applications in regions of the electromagnetic spectrum from the ultra-violet (UV, wavelength $\lambda$~300 nm) to the x-ray range ($\lambda$<1 nm). However, there is a need for stable, long-life light sources in the EUV region of the spectrum, $\lambda$=10 to 50 nm), particularly for EUV lithography (EUVL).

EUVL is expected to succeed Deep UV lithography technology for the production of silicon-based computer chips, at and beyond the 35 nm node. This technology is expected to take over fabrication in the 2007-2009 time frame. The stepper machines that print these chips are expected to cost $20-40 M each, and, in this time frame, anticipated sales of 200-300 units/year are expected, providing the three major stepper manufacturing companies, ASML (Netherlands & USA), Nikon and Canon (Japan), with a new $100 B/year market. The light sources for these steppers, are currently required to provide greater than 100 W of 'clean power' and can account for up to 20% of this total market. A source of sufficient power is identified as the principal problem area in the ITRS (SEMATECH) Roadmap for the development of EUVL. The roadmap has been modified periodically over the years to take into account the required increase in wafer throughput, larger (300 mm) wafers, and higher Cost of Ownership (CoO), and the power of the source demanded has progressively increased. $\lambda$ Currently the total required emitted power within a solid angle of 2$\lambda$, from a source of <1 mm in size within a 2% bandwidth at a wavelength of 13.5 nm, is 400 to 1000 W. This large amount of power is the major challenge for companies developing the light sources.

There are two primary types of light sources being developed, those that depend on electrical discharge plasma, and those that use a laser-plasma source. Both approaches operates at frequencies in excess of 6 kHz, with pulse-to-pulse stability of approximately 1% . They are also required to be capable of long term operation (up time >95%), and 'clean' operation. By 'clean' operation we mean 'debris-free' or protected from the effects of particulate emission and plasma ions emanating from the source.

Both laser plasmas and discharge plasmas can produce high velocity particulate emission or 'projectiles' that will damage the expensive, precision-coated EUV collection mirrors that are in direct line-of-sight of the source. In laser plasmas, this particulate debris can originate from solid target sources, or close-proximity nozzles used to inject gaseous targets. In discharge sources the debris originates from the electrodes or from insulative materials close by. The plasma ions are, of coarse, inherent to the plasmas themselves. They need to be stopped from sputtering (ablating) the collection mirrors. Several techniques have been devised to stop the sputtering, including Repeller Field approach disclosed in U.S. Pat. No. 6,377,651 issued to Richardson, et al. on Apr. 23, 2002, which is incorporated by reference.

Companies developing discharge plasmas (DP) include Philips (Hollow-Cathode Plasma Discharge), Xtreme Technologies (HC Z-pinch), Cymer (Dense Plasma Focus), Plex LLC (star discharge), Gygaphoton (capillary discharge pinch plasma). Most of these companies are focusing their R&D activities on Xenon-based plasmas. Although the use of Xenon mitigates the debris problem to some extent, the principal drawback is its low conversion efficiency into in-band, 13.5 nm EUV light. Both DP and LP sources have been limited to conversion efficiencies (CE) of 0.5 to 0.7%. The highest known CE is 0.95%. Moreover, there are now solid, atomic physics, reason to believe that the CE of Xenon will not improve much beyond these values.

These low CE's have adverse implications for both discharge plasma and laser plasma sources. For the laser plasma it means the use of a laser system having a power in excess 40 k W, beyond known technical capabilities and possibly prohibitively expensive. For discharge plasma sources, the low CE poses extreme problems with heat removal from the source and very large electrical power requirements, approaching 1 MW.

One approach for laser plasma sources uses microscopic, mass-limited, spherical targets composed of several materials including a small amount of tin. Tin is a metal and can, in principal pose a more serious debris problem as an EUV source. However, it has the advantage that much higher CE's are possible. CE's of 1-2% have been demonstrated and there is reason to believe higher values are possible.

The possible advantages of introducing tin into the discharge region of the source have been recognized and cursory tests completed. Use of electrodes made of tin-containing material, or using some method (thermal evaporation, or electron-beam heating) to introduce a tin vapor into the discharge has been disclosed. It is believed that the results have been disappointing for one or more reasons including, creation of large amounts of debris, instabilities in the discharge, and difficulties foreseen in scaling to the required powers. These difficulties originate from the inability to inject into the discharge a precisely known quantity of tin atoms, the minimum quantity that is required for the discharge to radiate 13.5 nm light efficiently.

The present invention advances the art by inclusion of method, apparatus and system that generates a cloud of nano-droplets for use as an X-ray, XUV, EUV, and EUV lithography light source and as a seed for a hollow cathode plasma discharge (HCPD) and dense plasma focus (DPF) source. The principle is the rapid transformation of a micro-target of mixed materials into a cloud of nano-droplets or nanoparticles. Incorporation of the nanoparticle generator into a plasma discharge light source, converts the plasma into a nanoparticle dominated plasma that produces a short-wavelength light and improves efficiency.

SUMMARY OF THE INVENTION

The first objective of the present invention is to provide a method, apparatus and system for generating a cloud of nano-droplets or nanoparticles from the rapid transformation of a microparticle mixed materials.

The second objective of the present invention is to provide a method, apparatus and system for generating a cloud of nano-droplets or nanoparticles for use as an X-ray light source.

The third objective of the present invention is to provide a method, apparatus and system for generating a cloud of nano-droplets or nanoparticles for use as an XUV light source.

The fourth objective of this invention is to provide a method, apparatus and system for generating a cloud of nano-droplets or nanoparticles for use as an EUV light source.

The fifth objective of the present invention is to provide a method, apparatus and system for generating a cloud of nano-droplets or nanoparticles for use in EUV lithography.

The sixth objective of the present invention is to provide a method, apparatus and system for generating a cloud of nano-droplets or nanoparticles as a seed for a Hollow Cathode The seventh objective of the present invention is to provide a method, apparatus and system for generating a cloud of nano-droplets or nanoparticles as a seed for a dense plasma focus (DPF) source.

The method, apparatus and system of the present invention generates a cloud of nano-droplets for use as an X-ray, XUV, EUV, and EUV lithography light source and as a seed for a hollow cathode plasma discharge (HCPD), Star discharge (SD) and dense plasma focus (DPF) source, and other sources. The principle is the rapid transformation of a micro-target of mixed materials into a cloud of nano-droplets or nanoparticles. The micro-target includes at least two materials, an evaporant and a nanoparticle material.

The method, apparatus and system includes a dispenser for dispensing a target stream of microparticles, a light source and a focus lens for focusing the light source on the target stream. The target stream of dispensed microparticles, or micro-droplets, are arranged to pass through the focus of the lens that focuses the light source onto the target stream. The energy absorbed from the light source heats the material of the microparticle, generating nano-droplets. Incorporation of the nanoparticle generator into a plasma discharge light source, converts the plasma into a nanoparticle dominated plasma that produces a short-wavelength light and improves efficiency. With the integration of the novel nanoparticle generator, these discharge lamps would work the same way they do now with a gaseous medium, with the exception that the gaseous medium would be modified, and seeded with a known number of nanoparticles of elements.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiment of the present invention in detail it is to be understood that the invention is not limited in its applications to the details of the particular arrangement shown since the invention is capable of other embodiments. Also, the terminology used herein is for the purpose of description and not of limitation.

The present method, apparatus and system generates a cloud of nano-droplets for use as an X-ray, XUV, EUV, and EUV lithography light source and as a seed for a hollow cathode plasma discharge (HCPD) and dense plasma focus (DPF) source, Star Plasma Device or any other electrical discharge plasma source. The principle is the rapid transformation of a micro-target of mixed materials into a cloud of nano-droplets or nanoparticles. The micro-target includes at least two materials that are categorized as either an evaporant or a nanoparticle material (NPM). Typical NPM's might be any metal, particularly metals with low melting points (such as Copper, Zinc, Lead, Tin, Silver, Antimony, Gold, Aluminum Lithium, etc or a non metal with a relatively high melting point. A list of some possible NPM's is included in Table 1.

TABLE 1

List of Nanoparticle materials

| Material | Melting point (° C.) | Latent Heat of Fusion (J/g) |
|---|---|---|
| Lithium | 181 | 432 |
| Aluminum | 660 | 396 |
| Antimony | 630 | 165 |
| Arsenic | 613-817 | 370 |
| Astatine | 302 | 114 |
| Barium | 725 | 56 |
| Bismuth | 271 | 52 |
| Cadmium | 321 | 54 |
| Calcium | 840 | 216 |
| Cerium | 799 | 66 |
| Cesium | 29 | 16 |
| Copper | 1083 | 206 |
| Gallium | 30 | 80 |
| Germanium | 937 | 439 |
| Gold | 1064 | 63 |

TABLE 1-continued

List of Nanoparticle materials

| Material | Melting point (° C.) | Latent Heat of Fusion (J/g) |
|---|---|---|
| Indium | 157 | 28 |
| Lanthanum | 921 | 81 |
| Lead | 328 | 23 |
| Magnesium | 649 | 369 |
| Plutonium | 640 | 11 |
| Potassium | 63 | 59 |
| Praseodymium | 931 | 71 |
| Radium | 700 | 37 |
| Rubidium | 39 | 27 |
| Selenium | 217 | 69 |
| Silver | 961 | 105 |
| Sodium | 98 | 113 |
| Strontium | 769 | 105 |
| Sulphur | 113 | 44 |
| Tellurium | 450 | 137 |
| Thallium | 306 | 21 |
| Tin | 232 | 61 |
| Ytterbium | 819 | 53 |
| Zinc | 420 | 114 |

Typical evaporants might be any liquid such as water, alcohol, methane etc., any liquid with a low boiling point, and may include any low boiling point material that is chemically attached to the NPM (such as Chlorine, Fluorine, Oxides, and the like). The evaporant and the nanoparticle material forms a, microparticle which is used interchangeably with or micro-droplet, and micro-target.

Figure 1A:
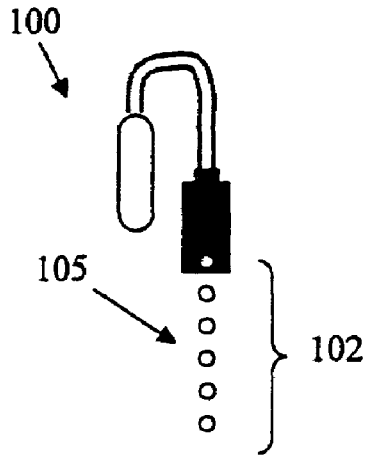
FIG. 1A illustrates a dispenser for dispensing a steady stream of microparticles or micro-droplets.
Figure 1B:
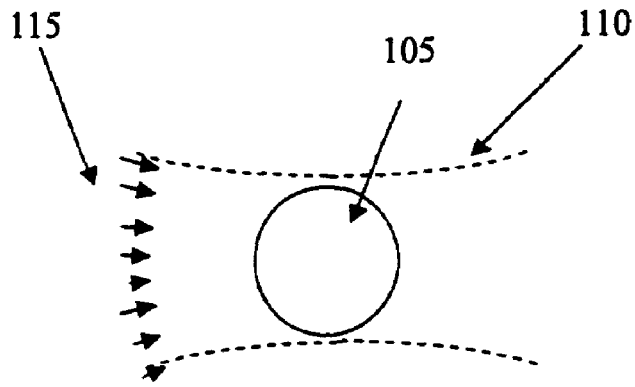
FIG. 1B illustrates a dispensed micro-particle passing through the focus of a lens that focuses the output of a pulsed laser onto the microparticle.
Figure 1C:
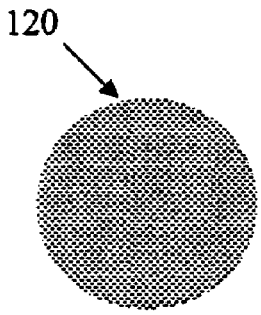
FIG. 1C illustrates the microparticle of FIG. 1B superheated above vaporization of the evaporant material.
Figure 1D:
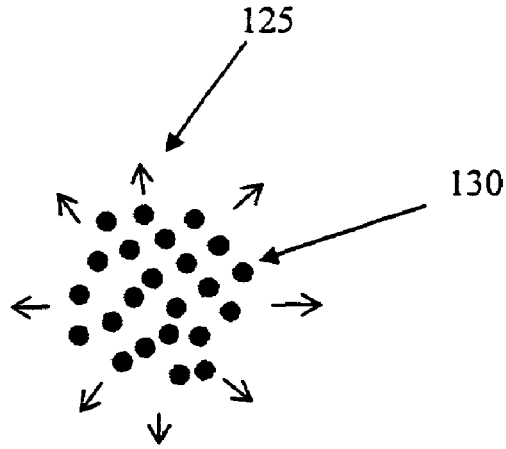
FIG. 1D illustrates the nanoparticles or nano-droplets diffusing outward.
Figure 2:
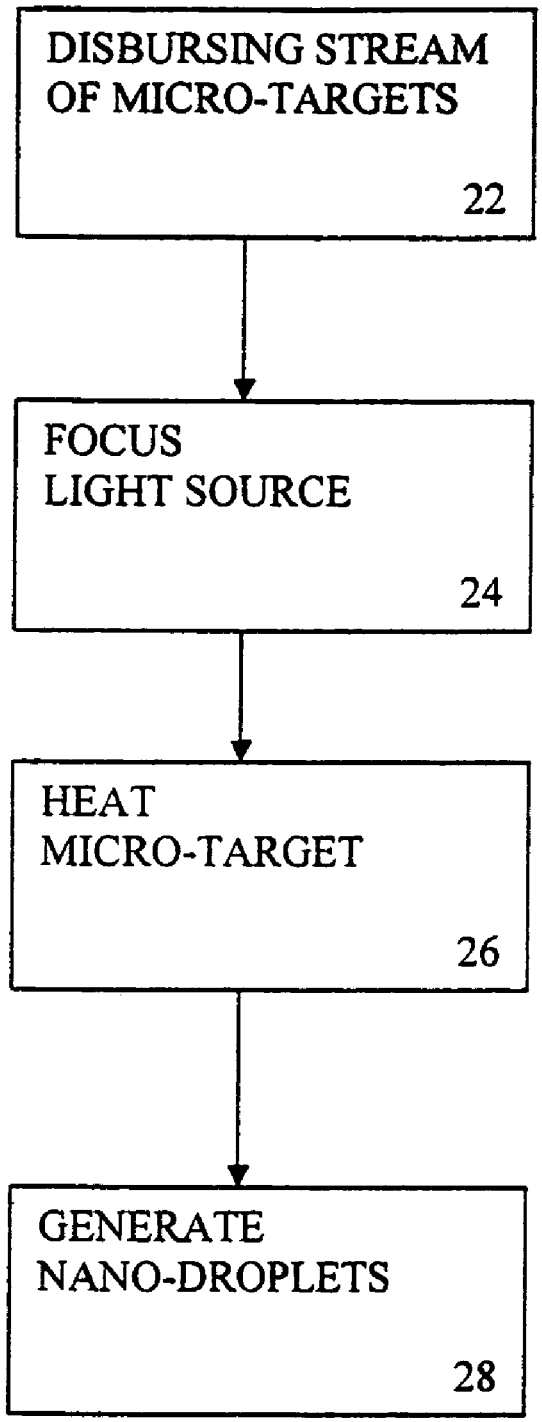
FIG. 2 is a flow diagram of a method of generating nanoparticles.

FIG. 1A through FIG. 1D illustrates the stages of transformation of a single microparticle into a cloud of nanoparticles and FIG. 2 is a flow diagram of the transformation method.

In FIG. 1A, a dispenser system 100 is used to create a steady stream 102 of microparticles 105 or micro-droplets in step 22 of FIG. 2, inside an enclosure, such as a vacuum enclosure. The dispenser 100 can be similar to the droplet systems devised for producing a water droplet target, or can be similar to an ink jet dispenser. It can also be a solid material dispenser such as a droplet solder dispenser or some other type of dispenser that produces microparticles having the two basic constituents, NPM and evaporant. The micro-targets 105 have a size varying from approximately 1 micron diameter to approximately 500 micron diameter.

As shown in FIGS. 1A and 1B, the dispenser 100 is arranged so that the micro-target 105 passes through the focus of a lens 110 that focuses the output 115 of a small pulsed laser onto the micro-target 105 in step 24 of FIG. 2. Each micro-target 105 is heated in step 26 of FIG. 2, by the pulse of energy 115 from the laser, super-heating the micro-target 150. The energy absorbed from the laser beam heats the materials of the micro-target 105. The temperature of the micro-target quickly rises above the boiling point of the evaporant, and below that of the NPM, and the evaporant 120 diffuses into the enclosure in step 26 of FIG. 2, as shown in FIG. 1C. The super-heating process is estimated to occur over a time of picoseconds to many microseconds.

Only small laser pulse energies, as low as approximately 1 micro Joule of laser energy, is required for super-heating the micro-target. For instance, for an approximately 30 micron diameter micro-target, the laser pulse energy can be a few micro joules. When the evaporant material boils into a vapor 120, it will start to explode the microparticle. When the temperature of the microparticle material is above the melting point, then the atoms of this microparticle material will coalesce into clusters or small aerosols, nanoparticles 130, while the vapors 120 of the evaporant material will be driven off as gases 125 as shown in FIG. 1C. In step 26 of FIG. 2, the exploding evaporant will tend to blow the NPM nanoparticles 130 outward, away from the focus as shown in FIG. 1D.

Control of the irradiation conditions (laser pulse energy, pulse duration, wavelength, focal spot size), the particle conditions (size, material composition), and the exposure chamber environment, provides control over the size and size-distribution of the nanoparticles created. The size of the resultant nanoparticle may be determined by commonly known techniques such as simple witness plate detection techniques.

Figure 3A:
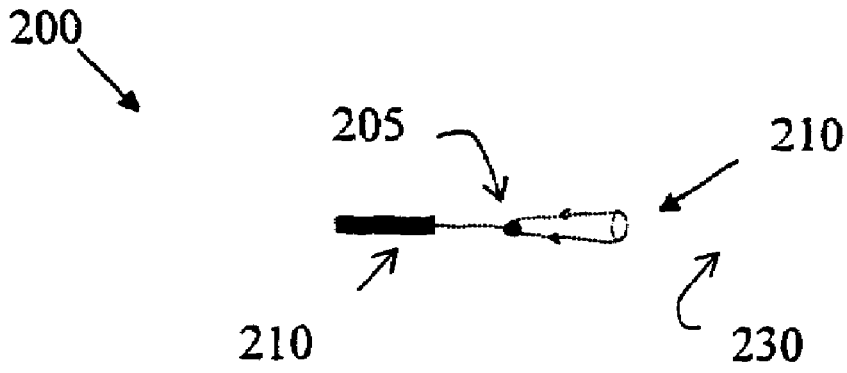
FIG. 3A illustrates the primary components of a preferred embodiment of the nanoparticle generator.

In FIG. 3A, the nanoparticle generation system 200 consists of a droplet dispenser 210 for dispensing microparticles 205, a lens 220 as a focusing element, and a burst of pulsed laser energy 230 transmitted from a source, such as an optical fiber. The droplet dispenser 210 consists of a system that generates a high speed stream of micro-droplets of materials, initially in a liquid form. As previously discussed, the microparticles include a nanoparticle material and an evaporant. Typical diameters of the microparticle are approximately 10 microns to approximately 200 microns. The stream is precise in trajectory, following a path that is accurate to within a few microns over many (>10 mm) millimeters long. The frequency of generation of microparticles can be varied over a range of approximately 10 kHz to approximately 1 MHz, and can be accurately synchronized to an external event. Therefore, the nanoparticle generation system of the present invention can be synchronized to many types of external laser.

Figure 3B:
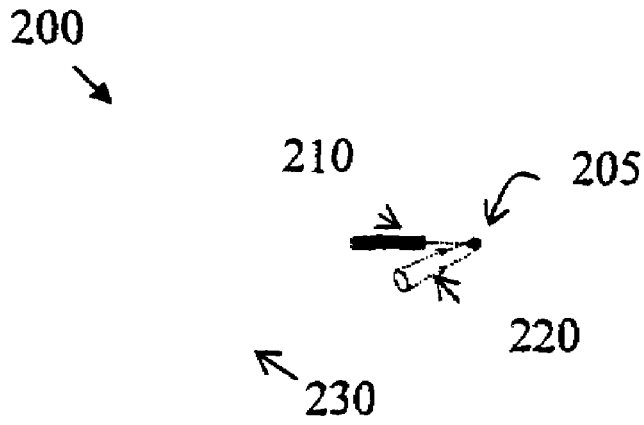
FIG. 3B illustrates another embodiment of the primary components of the nanoparticle generator.

The laser required to convert the microparticles into nanoparticles is not required to be sophisticated. A mall, diode-pumped Nd:YAG laser with a fiber optic output producing a few millijoules of energy is sufficient. The fiber optic coupler, the focusing element 220 and the droplet dispenser 210 can be fabricated to fit into a cylindrical assembly having a diameter of approximately 1 mm or less. As shown in FIG. 3B, the two principal components, the droplet dispenser 210 and the laser focusing system 220, do not need to be collinear. The nanoparticle generation system can be configured to be co-axial, with the microparticle and focused laser beam coming from the same direction.

In an embodiment, the nanoparticle system of the present invention is integrated with plasma devices and electrical discharge plasmas, particularly, though not limited to, those that are used as X-ray, XUV or EUV light sources. A discharge lamp is a leading candidate as an approximately 13.5 nm light source for EUV lithography. X-ray, XUV or EUV emitting discharge lamps currently use a gas as the initial plasma medium. The spectral characteristics of the light source are therefore limited to the spectral characteristics that can be afforded those gases that can be used in the discharge. This limits the accessibility of specific wavelengths which would result in improved efficiency. For example, the EUVL requires a very bright light at approximately 13.5 nm with an approximately 2% bandwidth (approximately 0.27 nm).

Xenon is one gas that provides emission at this wavelength in a discharge plasma. The emission primarily comes from excited states of $Xe^{10+}$. However, the efficiency of light generation at this wavelength in Xenon is extremely small, approximately 0.7%. Were the wavelength to be approximately 11.0 nm, the preferred wavelength for Xenon, the efficiency would be ten times higher. This is a general problem with high power short-wavelength light sources. The limited number of atomic gases in the Mendeleyev Table allow only a small number of discrete wavelengths to be generated with good efficiency. The method, system and device of the present invention expands the range of selectivity, by increasing the number of materials that can be used in a discharge light source, essentially to include nearly all of the elements in the periodic table.

With the integration of the novel nanoparticle generator, these discharge lamps would work the same way they do now with a gaseous medium, with the exception that the gaseous medium would be modified, and seeded with a known number of nanoparticles. For instance, in the case of the approximately 13.5 nm light source for EUVL, discharge light sources would be modified to operate with gases seeded with a predetermined number of Tin nanoparticles. In-band conversion efficiencies of several percent are then possible. Moreover, with an optimized conversion efficiency, the number and size of nanoparticles generated from each droplet can be adjusted so that all nanoparticles of tin (or other materials) are completely ionized, thereby minimizing the associated debris.

The nanoparticle generator is sufficiently small and rugged and can therefore be incorporated in different regions of a conventional plasma discharge design. The configuration and placement of the nanoparticle generator within a particular plasma discharge design depends on a number of factors, including the lamps overall design and operation, thermal considerations, and the plasma environment. It may be advantageous to protect the components of the nanoparticle generator from the effects of electrode debris and plasma erosion.

Incorporation of Nanoparticle Generator in Plasma Discharge Light Sources

While there are many possible designs of discharge plasma light sources that the nanoparticle generator of the present invention can be incorporated into, the nanoparticle generator is described for use with a hollow cathode discharge plasma source and a dense plasma focus source for purpose of illustration and discussion, not of limitation.

Hollow Cathode Discharge Plasma Source

Figure 4A:
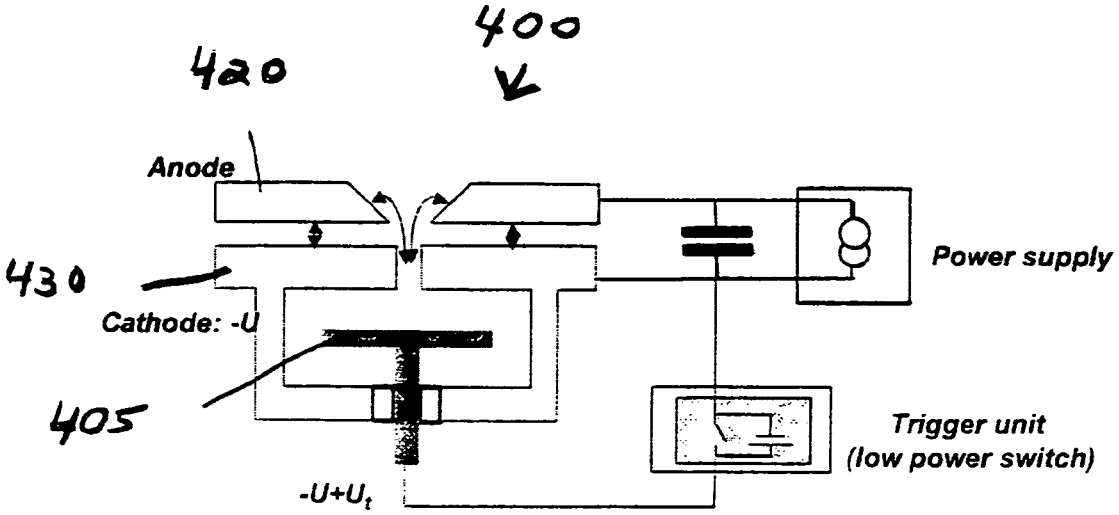
FIG. 4A illustrate a hollow cathode plasma discharge (HCPD) lamp.
Figure 4B:
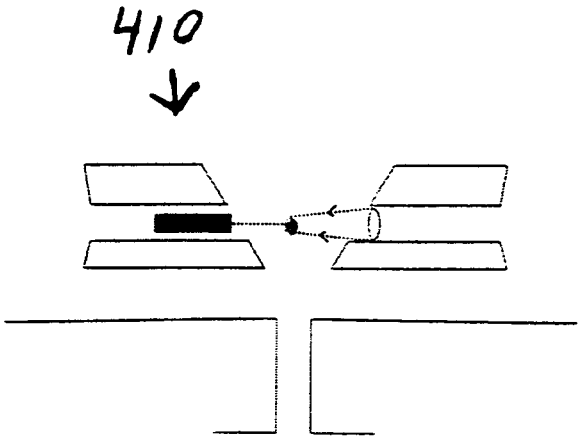
FIGS. 4B and 4C illustrate integration of the nanoparticle generator of the present invention as a seed for a hollow cathode plasma discharge (HCPD) lamp.
Figure 4C:
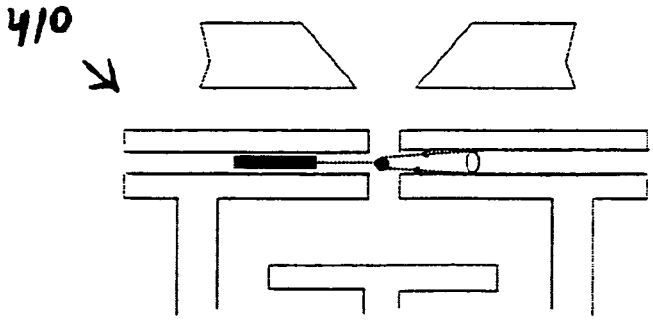

The Hollow Cathode Plasma Discharge (HCPD) lamp design 400 of FIG. 4A is particularly well suited for improvement with integration the novel nanoparticle generator. FIGS. 4B and 4C illustrate two examples of integrating the nanoparticle generator 410 with the hollow cathode discharge plasma source 400.

The Xenon gas HCPD plasma is created between two electrodes, the anode 420 and the cathode 430, in a static atmosphere of low pressure Xe. This gas is first pre-ionized by partially ionizing the gas between a pre-ionizing planar electrode 405 shown in FIG. 4A. Pre-ionization produces a uniform level of electrical conductivity within the gas prior to the main discharge. When the main discharge occurs, the strong transient electrical current flowing through the plasma located centrally between the cathode 430 and anode 420 produces a pinched, high temperature Xe plasma. The size of the plasma is a few millimeters long and less than a millimeter in diameter.

The conversion of this plasma lamp to a nanoparticle dominated plasma could be effected by one of the examples illustrated in FIG. 4B or 4C. The gas composition of the plasma needs to be maintained in order to ensure that the main pre-ionization, the pinch plasma sequence, occurs. This can be accomplished using He instead of Xe, or a mixture of He and other gases, to maintain the correct dynamic impedance of the discharge. At some point in the sequence of the discharge, an inert vapor of nanoparticles, such as Tin nanoparticles, are created by the nanoparticle generator 410. The nanoparticles are quickly ionized by the surrounding He plasma. There are several locations in this discharge where the nanoparticles can be injected. The closest location to the pinched plasma is the location inside the anode structure as shown in FIG. 4B. Another location might be inside the cathode structure, as shown in FIG. 4C. The optimum location for the nanoparticle generator, and it architecture and construction can differ based on the features of the discharge system.

Dense Plasma Focus Source

Figures 5A, 5B:
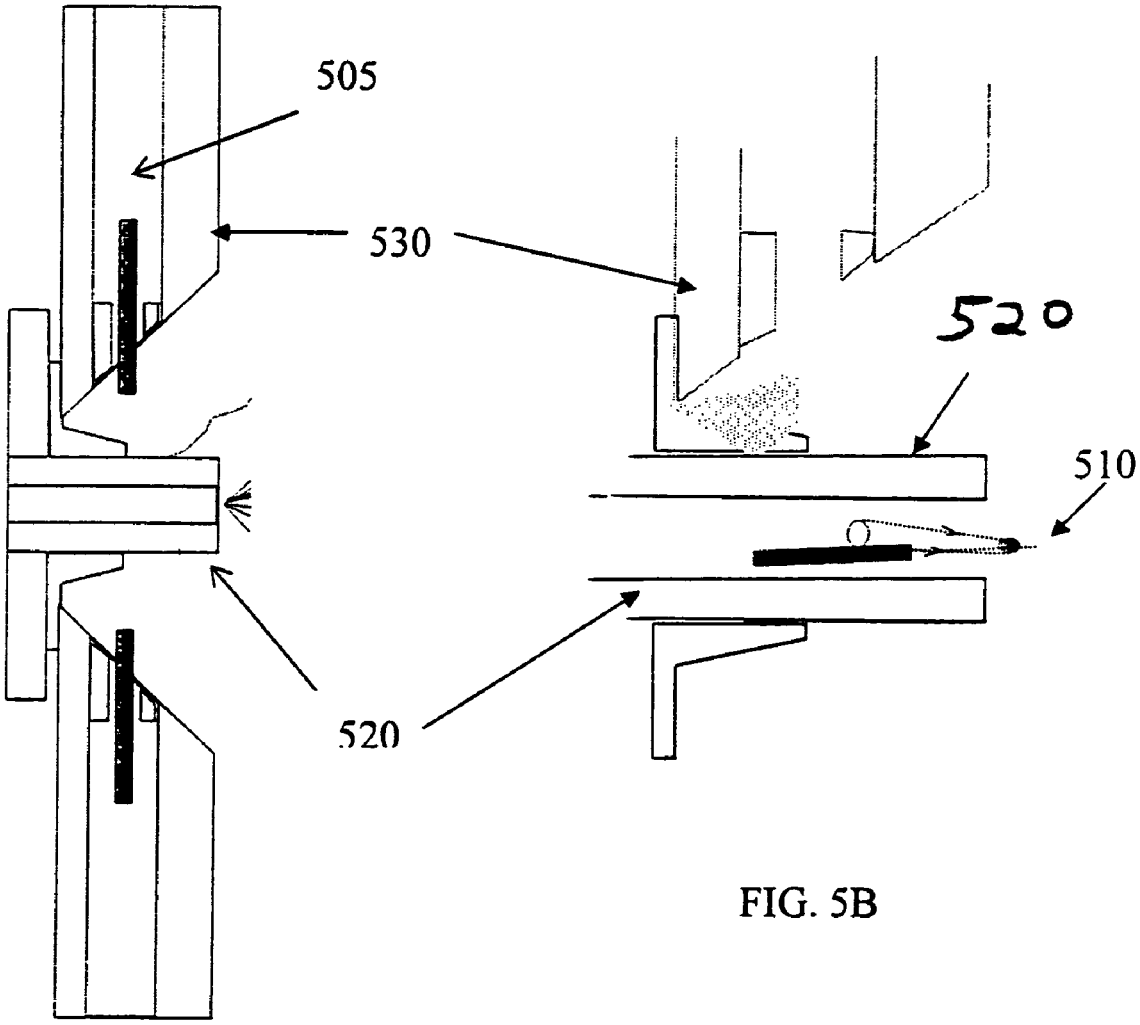
FIG. 5A illustrates a dense plasma focus (DPF) source.
FIG. 5B illustrates integration of the nanoparticle generator as a seed for dense plasma focus (DPF) source.

Another plasma discharge light source that is improved by incorporation of a seeded nanoparticle generator is the Dense Plasma Focus (DPF) discharge as shown in FIGS. 5A and 5B. In the DPF device, an initial plasma sheath is created between the anode and cathode across the insulator. The initiation of this sheath is improved with pre-ionization. The plasma then travels as a cylindrical sheath to the end of the anode 520, and then collapses on itself along the axis of the hollow anode 520. This pinched plasma is thus isolated from the electrodes 505, reducing erosion of the electrodes. The pinched plasma light source in Xe gas, or a mixture of inert gases, is typically a few millimeters in length and less than a millimeter in diameter. The DPF device can be seeded incorporating the novel nanoparticle generator in several ways. Two examples of configurations are shown in FIG. 5B and 600 FIG. 6B.

Figure 6A:
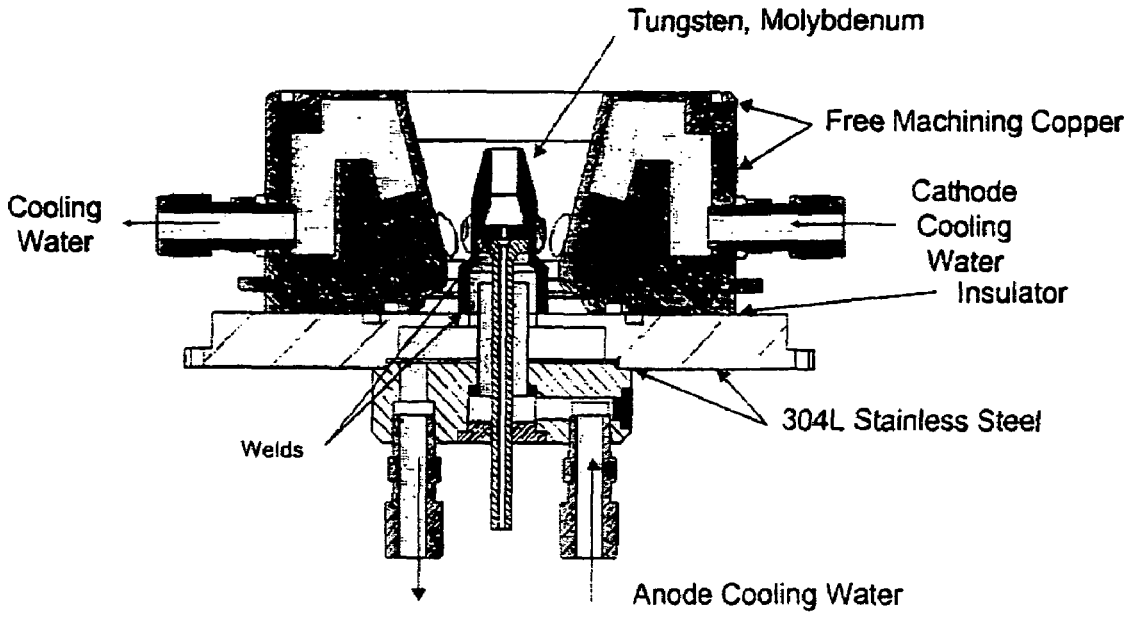
FIG. 6A illustrates another dense plasma focus (DPF) source.
Figure 6B:
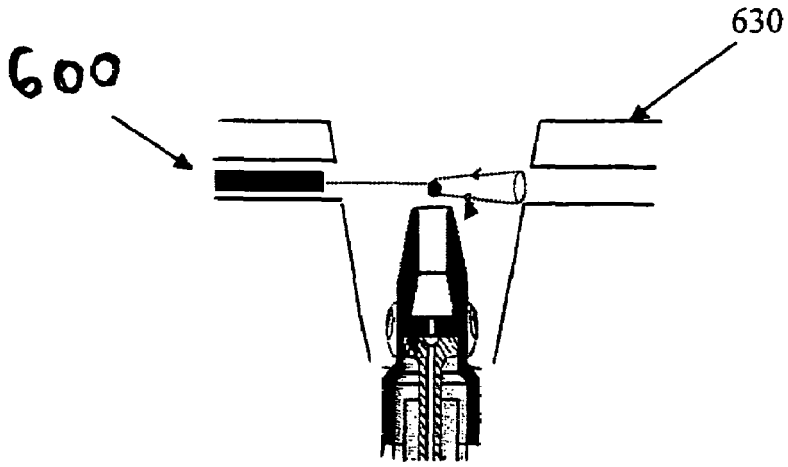
FIG. 6B shows another embodiment of the nanoparticle generator as a seed for a dense plasma focus (DPF) source.

In FIG. 5B, the nanoparticles are seeded through the anode 520, and in FIG. 6B, the nanoparticles are seeded from the cathode 630. In both cases the seeded nanoparticles are injected before the collapse of the pinched plasma. The pinched plasma will ionize, heat and excite the nanoparticles to temperatures sufficient for efficient short-wavelength emission. Synchronization of the injected microparticle in the plasma discharge cycle would be achieved in a similar manner as with the HCPD device.

The method, apparatus and system of the present generates a cloud of nano-droplets for use as an X-ray, XUV, EUV, and EUV lithography light source and as a seed for a hollow cathode plasma discharge (HCPD) and dense plasma focus (DPF) source. The principle is the rapid transformation of a microparticle of mixed materials into a cloud of nano-droplets or nanoparticles. The microparticle includes at least two materials, an evaporant and a nanoparticle material.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of generating nanoparticles from a single microdroplet, comprising the steps of:

dispensing a target stream of microdroplets from a source, each microdroplet consisting essentially of an evaporant and a nanoparticle material (NPM), each microdroplet having a diameter of approximately 1 micron to approximately 500 microns;

focusing a light source onto each next one of the microdroplets in the target stream;

heating the next microdroplet with the light source; and generating nanoparticles from the heated next microdroplet.

2. The method of claim 1, wherein the nanoparticle material includes: metal.

3. The method of claim 1, wherein the nanoparticle material includes: non-metal.

4. The method of claim 1, wherein the heating step includes:

raising temperature of the target stream above a boiling point of the evaporant and below that of the NPM.

5. The method of claim 4 wherein the rising temperature occurs over a time of approximately picoseconds to approximately microseconds.

6. The method of claim 1, wherein the light source includes a laser.

7. The method of claim 1, wherein microdroplet includes a diameter of approximately 30 microns and energy from the source is approximately 1 mJ (micro joules).

8. The method of claim 1, wherein dispensing the target stream includes dispensing microdroplets at a frequency from approximately 10 kHz to approximately 1 MHz.

9. The method of claim 1, further comprising the step of:

applying the method as an X-ray light source.

10. The method of claim 1, further comprising the step of:

applying the method as an XUV light source.

11. The method of claim 1, further comprising the step of:

applying the method as an EUV light source.

12. The method of claim 1, further comprising the step of:

integrating the method with a plasma discharge light source; and seeding a gas with nanoparticles.

13. The method of claim 12, further comprising the step of:

generating an approximately 13.5 nm light source.

14. The method of claim 12, further comprising the step of:

seeding a gas in a discharge light source with the nanoparticles.

15. The method of claim 12, wherein the nanoparticles include: tin.

16. The method of claim 12, wherein the gas includes: Xe.

17. The method of claim 12, wherein the gas includes: He.

18. The method of claim 1, further comprising the step of:

applying the method as a seed for a Hollow Cathode Plasma Discharge (HCPD) lamp.

19. The method of claim 1, further comprising the step of:

applying the method as a seed for a dense plasma focus (DPF) source.

20. A system for generating nanoparticles from single microdroplets comprising:

means for dispensing a target stream of micro droplets from a source, each microdroplet consisting essentially of an evaporant and a nanoparticle material (NPM) each microdroplet having a diameter of approximately 1 microns to approximately 500 micron;

a light source for heating the microdroplets; and means for focusing the light source on the micro droplets of the target stream, one by one, to generate the nanoparticles.

21. The system of claim 20, further comprising:

a plasma light source; and means for seeding a gas in the plasma light source with the nanoparticles.

22. The system of claim 20, further comprising:

means for integrating the system as an x-ray light source.

23. The system of claim 20, further comprising:

means for integrating the system as an XUV light source.

24. The system of claim 20, further comprising:

means for integrating the system as an EUV light source.

25. Device for generating nanoparticles from a single microdroplet comprising:

a dispenser for disbursing a targets stream of microdroplets, each microdroplet consisting essentially of an evaporant and a nanoparticle material (NPM), each microdroplet having a diameter of approximately 1 micron to approximately 500 microns;

a light source for heating the target stream; and a focusing lens for causing the light source on the target stream to generate nanoparticles form the microdroplets.

26. The device of claim 25, wherein the light source comprises a laser.

27. The device of claim 25, wherein the dispenser and the focusing lens are collinear.

28. The device of claim 25, wherein the dispenser and the focusing lens are coaxial.

29. A nanoparticle-seeded short-wavelength discharge source comprising:

a plasma discharge light source;

a device for generating nanoparticles from a stream of microdroplets, each microdroplet consisting essentially of an evaporant and a nanoparticle material (NPM), each microdroplet having a diameter of approximately 1 micron to approximately 500 microns; and means for seeding a discharge gas with the nanoparticles.

30. The discharge source of claim 29, wherein the discharge gas comprises: He.

31. The discharge source of claim 29, wherein the discharge gas comprises: Xe.

32. The discharge source of claim 29, wherein the nanoparticle generating device comprises:

means for dispensing a target stream of micro droplets from a source, each micro droplet consisting essentially of an evaporant and a nanoparticle material (NPM), each micro droplet having a diameter of approximately 1 micron to approximately 500 microns;

a light source; and means for focusing the light source on the micro droplets of the target stream, one by one, to generate the nanoparticles.

33. The discharge source of claim 29, wherein the microdroplets includes: at least two basic constituents, nanoparticle material (NPM) and evaporant.

34. The discharge source of claim 29, wherein the discharge light source comprises: an X-ray light source.

35. The discharge source of claim 29, wherein the discharge light source comprises: an XUV light source.

36. The discharge source of claim 29, wherein the discharge light source comprises: an EUV light source.

37. The discharge source of claim 29, wherein the discharge light source comprises: a Hollow Cathode Plasma Discharge (HCPD) lamp.

38. The discharge source of claim 29, wherein the discharge light source comprises: a dense plasma focus (DPF) source.

* * * * *